US006460304B1

(12) United States Patent
Kim

(10) Patent No.: US 6,460,304 B1
(45) Date of Patent: Oct. 8, 2002

(54) WATERPROOFING STRUCTURE AND CONSTRUCTION METHOD THEREFOR

(76) Inventor: Choong-Yup Kim, 14-25, Kusam-dong, Eunpyung-ku, Seoul (KR)

( * ) Notice: Subject to any disclaimer, the term of this patent is extended or adjusted under 35 U.S.C. 154(b) by 0 days.

(21) Appl. No.: 09/287,257

(22) Filed: Apr. 7, 1999

(51) Int. Cl.[7] ..... E04B 7/00

(52) U.S. Cl. ..... 52/408; 52/409; 52/745.19; 52/746.1

(58) Field of Search ..... 52/408.413, 511, 52/518, 454, 745.06, 745.19, 746.1; 428/49, 57, 58, 119, 120, 192, 194, 344, 353, 354, 355 EP, 921

(56) References Cited

U.S. PATENT DOCUMENTS 5,557,896 A * 9/1996 Imeokparia ..... 52/408
5,711,116 A * 1/1998 Hasan ..... 52/58
5,784,845 A * 7/1998 Imeokparia ..... 52/408
5,784,846 A * 7/1998 Godschaix ..... 52/409
5,979,133 A * 11/1999 Funkhouser ..... 52/408
6,004,645 A * 12/1999 Hubbard ..... 52/409
6,055,786 A * 5/2000 Hubbard ..... 52/409

* cited by examiner

*Primary Examiner*—Beth A. Stephan
(74) *Attorney, Agent, or Firm*—Thomas R. Vigil

(57) ABSTRACT

A hybrid waterproofing structure and a construction method therefor are provided to prevent water leak on a housetop or roof, in which the structure is improved to take merits of an asphalt sheet and a coating waterproof material and supplement demerits thereof. The hybrid waterproofing structure includes a waterproof sheet in which the edges of connection portions keep a predetermined distance from each other, when the waterproof sheets are laid on the upper surface of a slab layer, where bottom hair roots of a nonwoven fabric are implanted and fused into the upper surface of an asphalt sheet, and upper hair trunks of the nonwoven fabric are protruded externally, and a coating waterproofing layer formed by coating liquid-phase coating waterproofing material on the upper surface of the waterproof sheet.

26 Claims, 9 Drawing Sheets

WATERPROOFING STRUCTURE AND CONSTRUCTION METHOD THEREFOR

BACKGROUND OF THE INVENTION

1. Field of the Invention

The present invention relates to a hybrid waterproofing structure which is used for preventing water leak on a housetop or roof, and a construction method therefor, and more particularly, to a hybrid waterproofing structure and a construction method therefor, in which merits of an asphalt sheet-like waterproofing material and a coating waterproofing material are taken and demerits thereof are supplemented.

2. Description of the Related Art

In a conventional asphalt sheet-like waterproofing structure as shown in FIG. 1, a plurality of unit asphalt sheets 21 each having a predetermined thickness and width and made of asphalt are laid on the upper surface of a concrete slab layer 10, in which connection portions "A" between the unit asphalt sheets are superimposed over each other in a 2-layered or 3-layered form. Here, the superimposed connection portions "A" are heated by a torch lamp to be melted and attached to each other. The slab layer 10 and the asphalt sheet 21 are attached to each other with an adhesive material. Here, a reference numeral 11 denotes an adhesive material layer.

The above-described asphalt sheet-like waterproofing structure has a waterproofing effect to a degree, since the connection portions "A" superimposed between the asphalt sheets are heated by the torch lamp to be melted and attached to each other. However, such the thermal heating of the connection portions "A" may cause them not to be uniformly attached to each other. That is, since holes may be produced due to excessive heating by the torch lamp, in the connection portions where the asphalt sheets are attached to each other, or complete attachment may not be achieved due to weak heating by the torch lamp, water leak can occur from the connection portions.

Thus, the above asphalt sheet-like waterproofing structure has the following disadvantages.

(1) Since connection portions overlaid between a plurality of unit asphalt sheets are deteriorated due to excessive heating or are not partly fused due to weak heating, water leak can occur therein.

(2) Since additional equipment such as a torch lamp, a gas vessel, a gas tube, etc., are required for heating, melting and attaching connection portions, fire or burn can take place. Accordingly, an efficiency of work is lowered.

Meanwhile, there is a polyurethane coating waterproofing structure as another waterproofing technique besides the above-described asphalt sheet-like waterproofing structure, in which only polyurethane is used to prevent water leak. In the polyurethane coating waterproofing structure as shown in FIG. 2, liquid-phase polyurethane is primarily coated on the upper surface of a concrete slab layer 10 to form a first polyurethane layer 31. After about 24 hours has elapsed, a second polyurethane layer 32 is formed on the first polyurethane layer 31 by the same method as the first layer. Then, after 24 hours has further elapsed, a third polyurethane layer is formed on the second polyurethane layer 32, to thereby complete the polyurethane coating waterproofing structure. Here, polyurethane is hardened at the normal temperature, which is called a cool hardening method. In this case, it is common that an adhesive layer 11 exists between the first polyurethane layer 31 and the slab layer 10.

The above polyurethane coating waterproofing structure has excellent properties and remarkable merits as a waterproofing material since the polyurethane waterproofing layer is formed without having connection portions and a cool hardening method reacted at the normal temperature is used.

However, the above polyurethane coating waterproofing structure has the following disadvantages.

(1) Since first, second and third polyurethane layers need hardening times when a waterproofing layer is formed in a predetermined thickness or more, a construction time is lengthy.

(2) When the upper surface of a concrete slab layer 10 is uneven, more urethane resin is collected in groove portions to thereby form a thicker layer, and less urethane resin is collected in protruding portions to thereby form a thinner layer.

(3) Bubbling or swelling can occur due to vapor pressure of water contained in the concrete in the polyurethane coating waterproofing structure before polyurethane has been hardened.

In particular, the above phenomena frequently occurs in summer time. Thus, when a water containing ratio in the concrete is 8% or more, the polyurethane coating waterproofing structure is prohibited in principle.

SUMMARY OF THE INVENTION

To solve the above problems, it is an object of the present invention to provide a hybrid waterproofing structure and a waterproof construction method therefor, in which an asphalt sheet-like waterproofing structure (or method) and a coating waterproofing structure (or method) are hybridized, to thereby take merits of the two structures and supplement demerits thereof.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

The waterproofing structure and the waterproof construction method according to the present invention have the following features.

(1) An adhesive force between an asphalt sheet and a coating waterproofing layer is enhanced to maximize a waterproofing reliability.

(2) A complete cool hardening method is used without using any thermal source when a waterproofing structure is fabricated.

(3) Any connection portions do not exist in the hybrid waterproofing structure.

(4) An asphalt sheet functions as the basis of a coating waterproofing layer. Thus, the coating waterproofing layer is not affected by a water containing condition of the concrete.

(5) A nonwoven fabric of a predetermined thickness on the upper surface of an asphalt sheet absorbs and hardens a coating waterproofing material. Accordingly, a coating waterproofing layer is coated in constant thickness and the nonwoven fabric reinforces the coating waterproofing layer as a reinforcing material.

(6) The whole construction is quickly and simply accomplished.

To accomplish the above object of the present invention, there is provided a hybrid waterproofing structure comprising: a plurality of waterproof sheets, each having a predetermined thickness and width and fabricated in the form of rolls in which the edges of connection portions keep a predetermined distance from each other, when the waterproof sheets are adhered on the upper surface of a slab layer, the waterproof sheet comprising an asphalt sheet formed of asphalt and a first nonwoven fabric in which hair roots produced on the bottom of the nonwoven fabric are implanted into the upper surface of the asphalt sheet, and hair trunks produced on the top of the nonwoven fabric are protruded externally; and a coating waterproofing layer formed by coating liquid-phase coating waterproofing material on the upper surface of the waterproof sheet.

To accomplish the above object of the present invention, there is provided a waterproofing construction method comprising the steps of: forming an adhesive material layer by applying an adhesive material to the upper surface of a slab layer in order to enhance an adhesive force; laying a plurality of waterproof sheets, each having a predetermined thickness and width in which the edges of connection portions keep a predetermined distance from each other, when the waterproof sheets are laid on the upper surface of the adhesive layer, where hair roots produced on the bottom of a nonwoven fabric are implanted and fused into the upper surface of an asphalt sheet, and hair trunks produced on the top of the nonwoven fabric are protruded externally; forming a coating waterproofing layer by coating liquid-phase coating waterproofing material on the upper surface of the waterproof sheet; and forming a finish layer on the upper surface of the coating waterproofing layer, to protect the coating waterproofing layer.

According to one embodiment of the present invention a waterproofing structure comprises a plurality of waterproof sheets arranged adjacent each other defining a joint region representing an area between neighboring grounding waterproof sheets separated by a predetermined distance, the plurality of waterproof sheets being disposed above the slab layer, wherein each one of grounding waterproof sheet has a water-proof first layer arranged above the slab layer, the first layer having first and second surfaces; and a second layer affixed to the first surface of the first layer, the second layer having fibers extending from at least one surface of the second layer and adhering to the first layer. The waterproof structure also has a hardenable polymer layer or other suitable water-proof layer formed by coating polymer on the upper surface of the plurality of grounding waterproof sheet. The polymer is preferably polyurethane.

According to one aspect of the present invention, the polymer layer may be selectively formed on the joint region or formed substantially on an entire upper surface of the plurality of grounding waterproof sheets. The first layer is preferably an asphalt sheet. The second layer is preferably a nonwoven material, such as nonwoven fabric or glass.

According to another aspect of the present invention, the fibers extend from the other surface of the second layer and adhere to the polymer layer. In addition, the waterproof sheet may have a third layer affixed to the second surface of the first layer. The third layer has fibers extending from at least one surface and adhering to the first layer. Preferably, the third layer is a nonwoven fabric.

According to another embodiment of the present invention, the process of preparing a waterproofing structure on a slab layer comprises the steps of arranging a plurality of grounding waterproof sheets on the slab layer, wherein the grounding waterproof sheets are arranged adjacent each other defining a joint region representing an area between neighboring grounding waterproof sheets separated by a predetermined distance, each one of grounding waterproof sheet having a water-proof first layer arranged above the slab layer, the first layer having first and second surfaces; and a second layer affixed to the first surface of the first layer, the second layer having fibers extending from at least one surface of the second layer and adhering to the first layer; and coating at least the joint region of the grounding waterproof sheets with hardenable polymer to form a polymer layer.

It is to be understood that both the foregoing general description and the following detailed description are exemplary and explanatory and are intended to provide further explanation of the invention as claimed.

BRIEF DESCRIPTION OF THE DRAWINGS

The object and other advantages of the present invention will become more apparent by describing in detail the structures and operations of the present invention with reference to the accompanying drawings, in which.

DETAILED DESCRIPTION OF THE PREFERRED EMBODIMENTS

Figure 1:
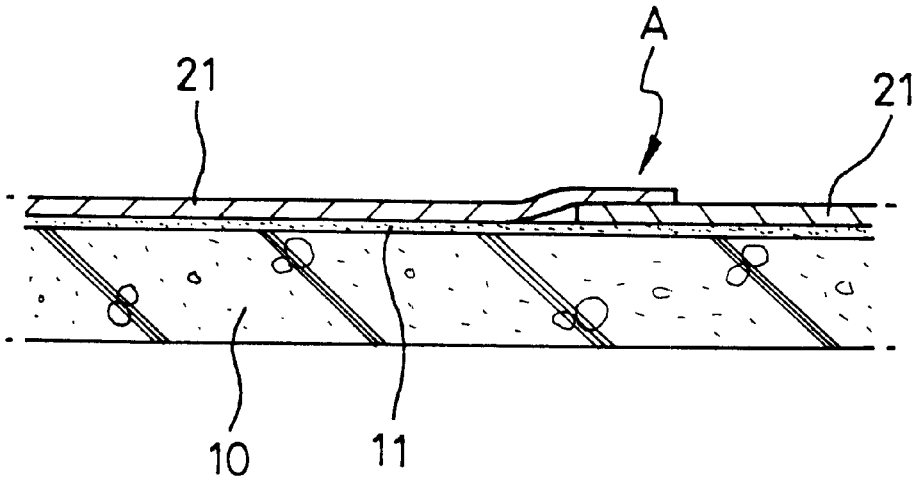
FIG. 1 (PRIOR ART)
FIG. 1 shows a prior art asphalt sheet-like waterproofing structure.
Figure 2:
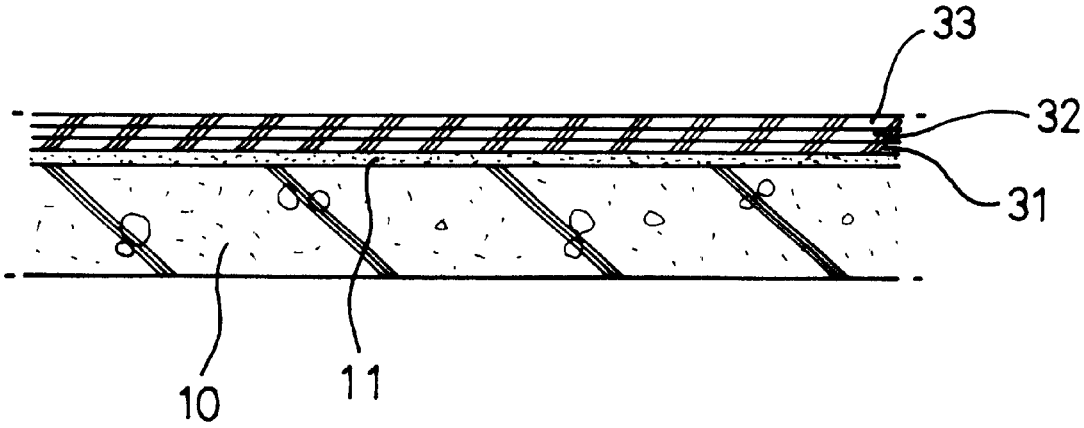
FIG. 2 (PRIOR ART)
FIG. 2 shows a prior art polyurethane coating waterproofing structure.
Figure 3:
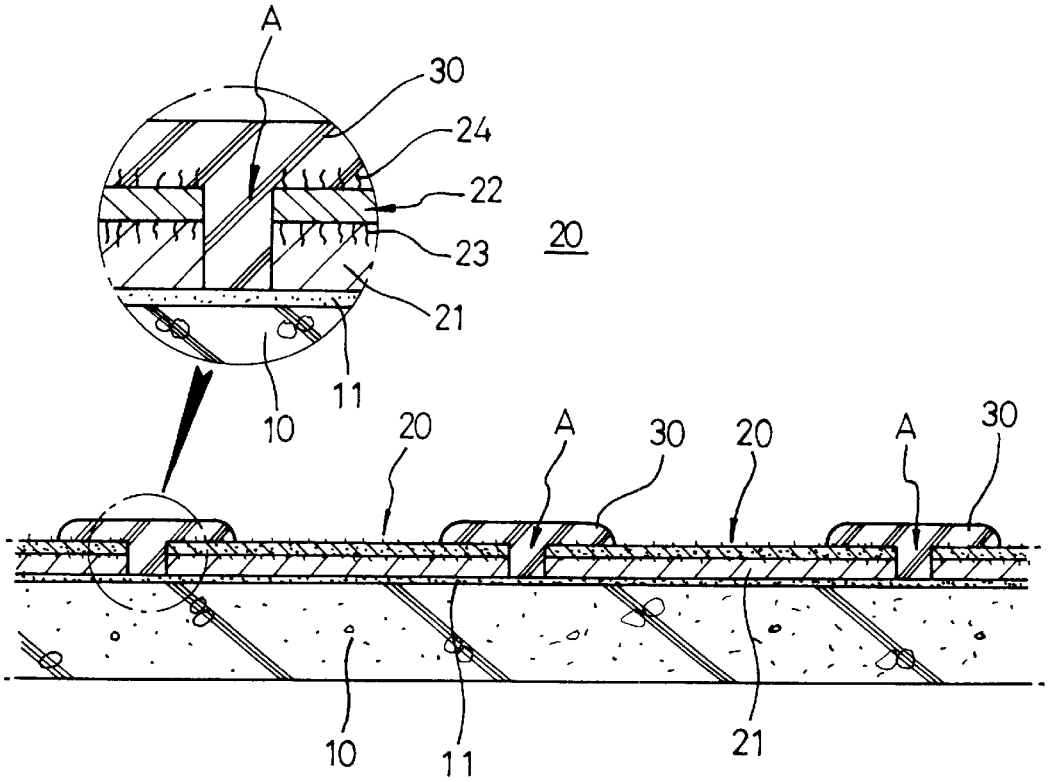
FIG. 3 is a cross-sectional view showing connection structures between waterproof sheets in a hybrid waterproofing structure according to a first embodiment of the present invention.
Figure 5A:
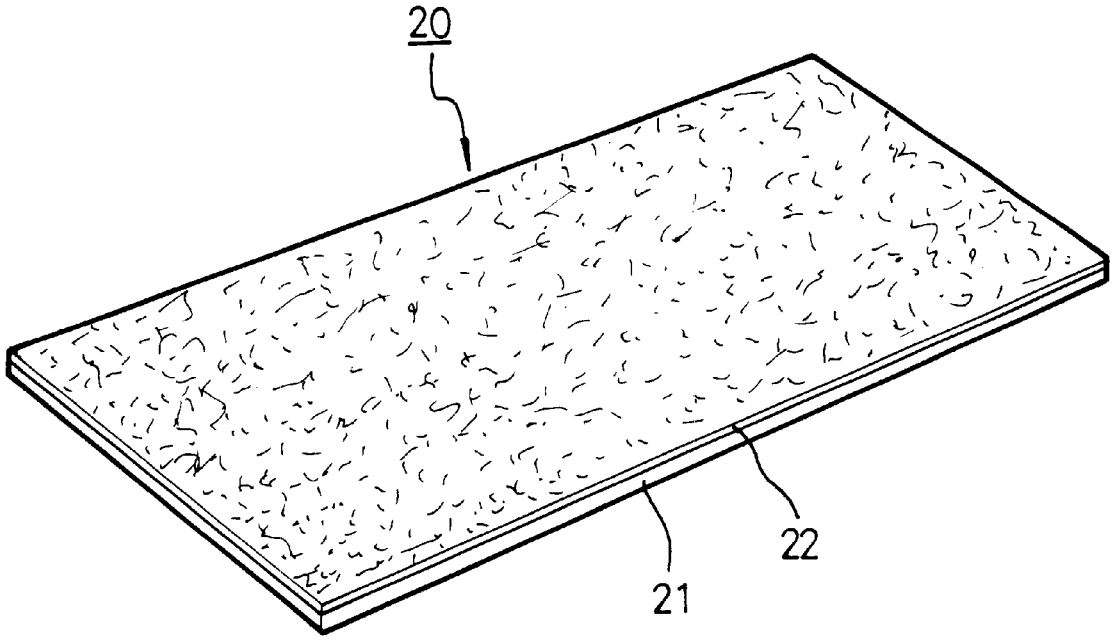
FIGS. 5A and 5B are a perspective view and a cross-sectional view showing the states where a nonwoven fabric is melted and attached on the upper surface of the asphalt sheet.
Figure 5B:
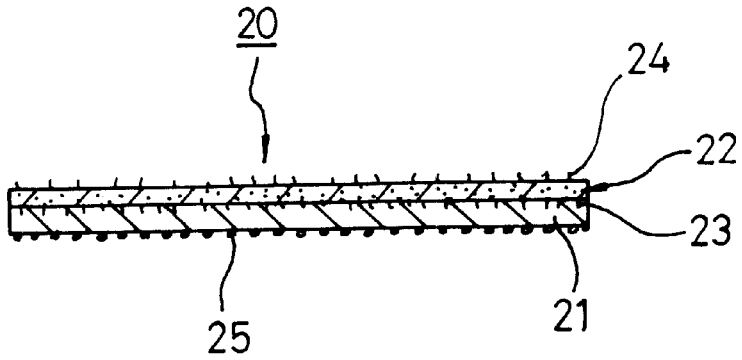

Preferred embodiments of the present invention will be described in detail with reference to the accompanying drawings. As shown in FIG. 3, a hybrid waterproofing structure according to the present invention is comprised of a waterproof sheet 20 and a coating waterproofing layer 30. The waterproof sheet 20 has a predetermined thickness and width and is preferably fabricated in the form of sheet as shown in FIGS. 5A and 5B and is alternatively provided in the form of a roll. The edges of connection portions "A" keep a predetermined distance from each other, when the waterproof sheets 20 are laid on the upper surface of a slab layer 10 or a roof. The separation distance "A" is about 0.5 cm to 1.5 cm and preferably is about 1.0 cm. Preferably, each waterproof sheet 20 has a width of about 1 m and a height of about 10–15 m. Here, hair roots 23 produced on the bottom of a nonwoven fabric 22 are implanted into the upper surface of an asphalt sheet 21 when the upper surface of an asphalt sheet 21 is still soft, and hair trunks 24 produced on the top of the nonwoven fabric 22 are protruded externally. The asphalt sheet 21 is preferably formed of normal asphalt, preferably rubberized asphalt. The waterproof sheets 20 have a non-adhesive liner 25, as shown in FIG. 5B, such as sand layer, thin polyurethane film or flaking paper formed on the bottom of asphalt sheet 21 so as to not adhere to each other when they are supplied in the form of roll.

The coating waterproofing layer 30 is formed of organic coating waterproofing material, for example, a polyurethane layer formed by coating liquid-phase polyurethane on the upper surface of the waterproof sheet 20. In addition, liquid-phase epoxy, liquid-phase poly-urea, EVA. emulsion, asphalt emulsion, acryl emulsion, or other suitable material known to one of ordinary skill in the art can be used as the coating waterproofing layer 30.

Here, an adhesive material is coated on the upper surface of the slab layer 10 to form an adhesive layer 11 to increase an adhesive force. In this case, the adhesive layer 11 is formed by coating subsequently, for example, primer and liquid-phase polyurethane on the slab layer 10.

Thus, since hair roots 23 on the bottom of a nonwoven fabric 22 are implanted into the upper surface of an asphalt sheet 21, and hair trunks 24 on the top of the nonwoven fabric 22 are protruded externally, the liquid-phase polyurethane coated on the upper surface of the asphalt sheet is deeply penetrated among the hair trunks 24 and firmly adhered to the asphalt sheet 21 as shown in FIGS. 3, 5A and 5B.

That is, the waterproof sheet 20 according to the present invention is preferably fabricated in factory with the hair roots 23 of the nonwoven fabric 22 implanted and fused into the upper surface of the asphalt sheet 21, and the hair trunks 24 protruded externally. The waterproof sheet 20 is then hybridized with the coating waterproofing layer 30 coated in site, to maximize an adhesive force.

Also, because the liquid-phase polyurethane 30 is coated at the state where the grounding waterproof sheet 20 formed of the asphalt sheet 21 and the nonwoven fabric 22 has been laid on the slab layer 10, the conventional defect inherent in the asphalt sheet 21 caused by a heating process can be supplemented by the polyurethane layer 30. Further, the disadvantages of using multiple polyurethane layers, such as high costs, state of the floor of the slab layer, and water-containing ratio of the slab layer can be supplemented by the asphalt sheet 21.

Because the grounding waterproof sheet 20, having a predetermined thickness and width and fabricated in the form of rolls, is simply laid on the floor during waterproofing, construction work is very simple and convenient. Also, since the hair roots 23 produced on the bottom of the nonwoven fabric 22 are implanted and fused into the upper surface of the asphalt sheet 21, and the hair trunks 24 produced on the top of the nonwoven fabric 22 are protruded externally, the liquid-phase polyurethane coated on the upper surface of the asphalt sheet is deeply penetrated among the hair trunks 24 of the nonwoven fabric 22, and thus the polyurethane layer 30 is firmly adhered to the grounding waterproof sheet 20.

For reference, an adhesive force between the asphalt sheet and the polyurethane layer is about 1.9 Kg/cm, and the adhesive force is about 3.2 Kg/cm when an epoxy adhesive is used between the asphalt sheet and the polyurethane, both of which are less than the Korean Standard (KS) value, 5.1 Kg/cm. Meanwhile, an adhesive force between the asphalt sheet 21 melted with the nonwoven fabric 22 and the polyurethane layer according to the present invention is about 8.9 Kg/cm which is close to double the value of the KS value.

Furthermore, the nonwoven fabric 22 increases the adhesive force between the asphalt sheet 21 and the coating waterproofing layer 30, and also increases a tensile force of the whole waterproofing structure since the nonwoven fabric 22 itself is formed of a tenacious netlike structure and is inserted between the asphalt sheet 21 and the coating waterproofing layer 30.

Figure 4:
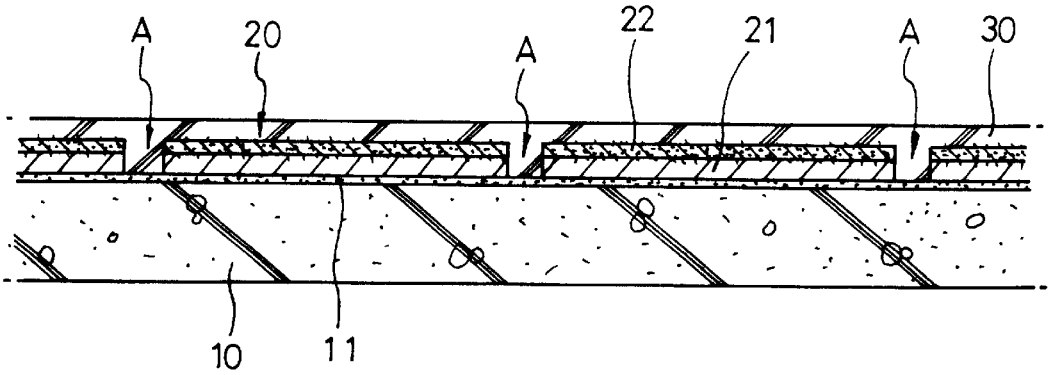
FIG. 4 is a cross-sectional view of a hybrid waterproofing structure of FIG. 3 with an alternative coating structure.

Referring to FIG. 4, the waterproof sheets 20 are laid on the slab layer 10 with the edges of the connection portions "A" spaced a little from each other. Differently from the conventional art where the asphalt sheets are overlapped in the 2-layered or 3-layered form and then heated by the thermal source to be attached to each other, the coating waterproofing layer 30 is penetrated between the spacing of the connection portions "A", is filled above the thickness of the asphalt sheet, is covered with glass fiber fabric (not shown), is deeply penetrated among the hair trunks 24 of the nonwoven fabric 22, and integrally hardened. That ensures the connection portions to be integrated with each other, and thus, the coating waterproofing layer 30 is firmly adhered to the waterproof sheet 20. Thus, since the coating waterproofing layer 30 are integrally formed without having additional connection portions, water leak can be perfectly prevented.

Since the waterproof sheets 20 are laid on the slab layer 10 and the liquid-phase polyurethane is coated on the waterproof sheet 20, the conventional problems and defects that the expensive polyurethane layer is not easy to be coated in constant thickness and a water proof layer of a constant thickness is not easy to be formed due to the unevenness of the floor of the concrete slab layer 10, and small pores are produced due to the vapor pressure of the water contained in the concrete slab layer 10, can be solved all at a time.

Further, the coating waterproofing layer 30 is formed as a water proof layer having a uniform thickness, since a predetermined amount of the liquid-phase polyurethane is coated on the flat nonwoven fabric 22.

While polyurethane is described in connection with the present invention, one skilled in the art will recognize that many alternative materials can be used, such as polyurea, acrylics, epoxies, hot melt adhesives or other polymers which can be readily applied to the surface of the object.

Figure 6A:
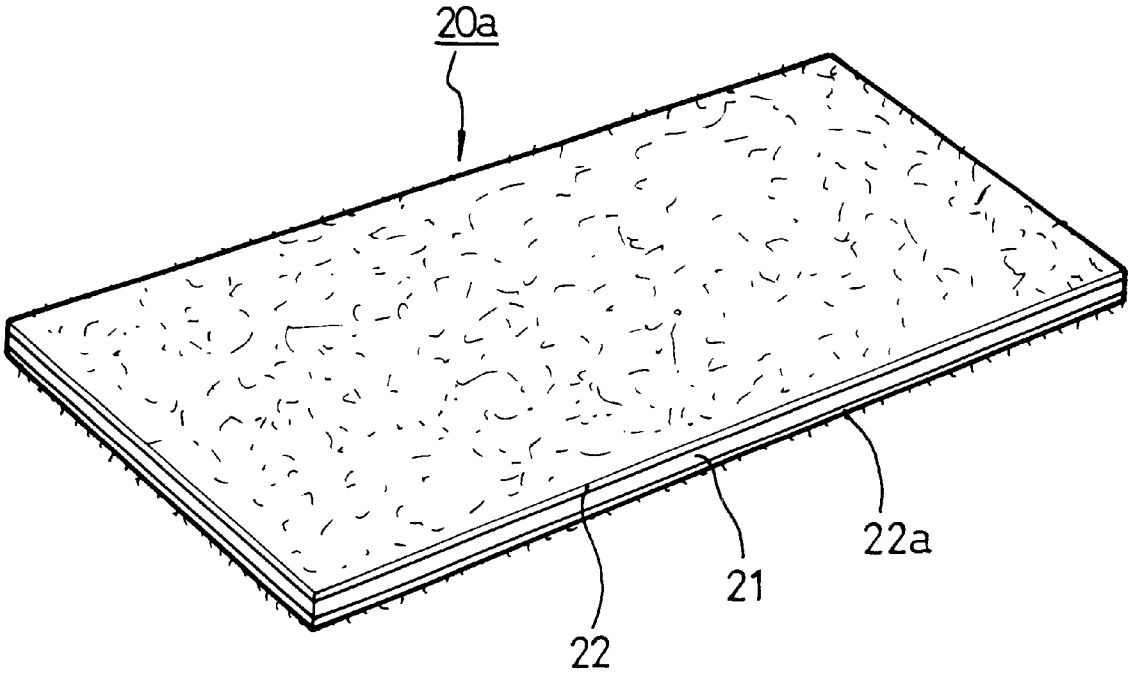
FIGS. 6A and 6B are a perspective view and a cross-sectional view showing nonwoven fabrics which are melted and attached on the upper and bottom surfaces of the asphalt sheet according to a second embodiment of the present invention.
Figure 6B:
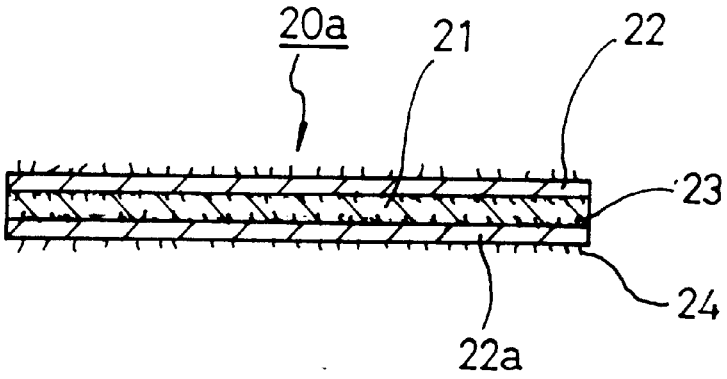
Figure 6C:
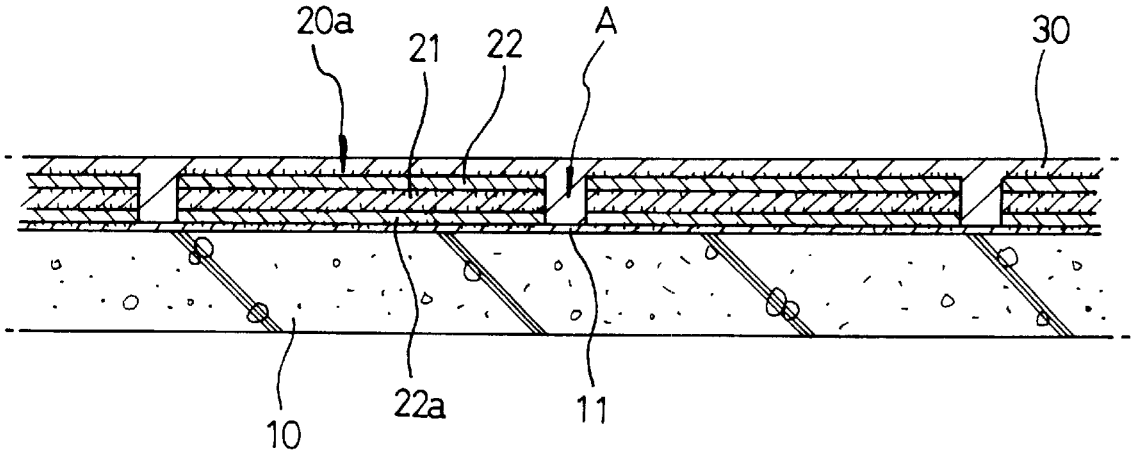
FIG. 6C is a cross-sectional view showing the second embodiment of a hybrid waterproofing structure.

Referring to FIGS. 6A through 6C, a waterproof sheet 20*a* can be produced in such a manner that hair roots 23 produced on the top of a nonwoven fabric 22*a* are implanted into the bottom surface of the waterproof sheet 20 shown in FIGS. 5A and 5B, and hair trunks 24 produced on the bottom of the nonwoven fabric 22*a* are protruded externally. Thus, the waterproof sheet 20*a* has upper and lower nonwoven fabrics 22 and 22*a*. The hybrid waterproofing structure using the waterproof sheet 20*a* is obtained as shown in FIG. 6C.

The polyurethane layer is formed by coating liquid-phase polyurethane on the upper surface of the waterproof sheet 20. Meanwhile, the word "polyurethane" is interchangeably used with the word "polyurethane layer" in the specification, in which the word "polyurethane" indicates the liquid-phase polyurethane which is used for coating and the word "polyurethane layer" indicates that the liquid-phase polyurethane is solidified into the solid-phase polyurethane.

Thus, the coating waterproofing layer 30 is coated on the upper surface of the waterproof sheet 20 and penetrated between the hair trunks 24 of the nonwoven fabric 22, to be firmly attached to the asphalt sheet 21. As a result, the coating waterproofing layer 30 is integrated with the asphalt sheet 21, to bond the connection portion "A" between the unit asphalt sheets 21.

Also, the coating waterproofing layer 30 is hybridized and constructed with the asphalt sheet 21, to play a role of supplementing the defect of the asphalt sheet. That is, the coating waterproofing layer 30 in the present invention is coated into the connection portions "A" to assure integration of the connection portions, in order to solve the conventional defects that the connection portions "A" overlapping between the unit asphalt sheets 21 should be heated and fused by a thermal source.

Meanwhile, the coating waterproofing layer 30 can be formed by a partial coating method where the polyurethane is coated on only the connection portions "A" of the waterproof sheet 20 as shown in FIG. 3. Alternatively, the coating waterproofing layer 30 can be formed by a whole coating method where the polyurethane is coated on the whole surface of the waterproof sheet 20 as shown in FIG. 4.

Figure 7:
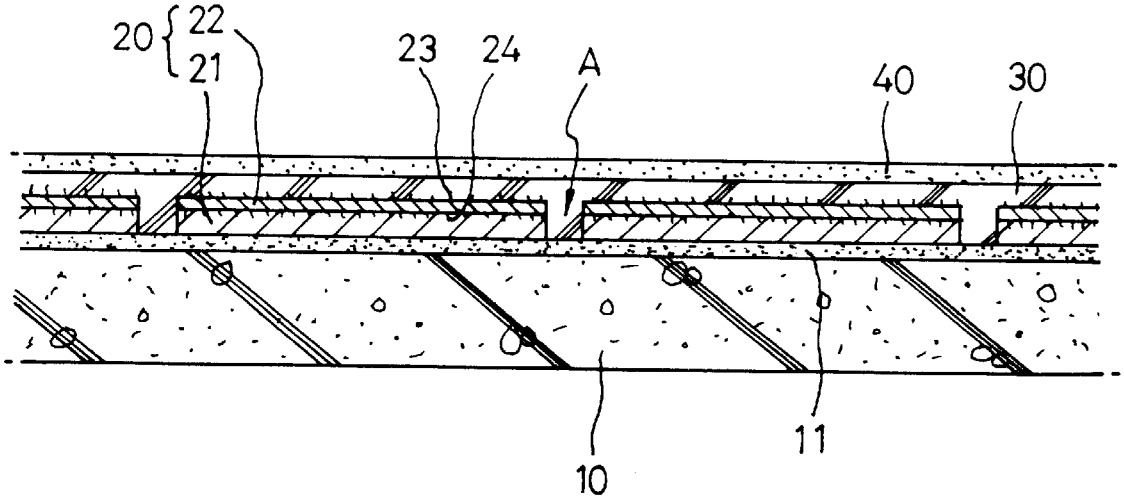
FIG. 7 shows the state where the hybrid waterproofing structure has been constructed by using a waterproofing construction method according to the first embodiment of the present invention.

A method for constructing the hybrid waterproofing structure as described above will be described below with reference to FIG. 7. The hybrid waterproofing structure constructing method includes an adhesive material layer forming step, a waterproof sheet laying step, a coating waterproofing layer forming step, and a finish layer formation step.

In the adhesive material layer forming step, an adhesive material layer 11 is formed by applying an adhesive material to the upper surface of a slab layer 10 in order to enhance an adhesive force. In this case, the adhesive layer 11 is formed by coating subsequently primer and liquid-phase polyurethane on the whole surface of the slab layer 10.

In the waterproof sheet laying step, the waterproof sheet 20 having a thickness of about 2.5 mm, length of about 15 m and width of about 10 m and fabricated in the form of rolls is laid on the upper surface of the adhesive material layer 11, in which the edges of connection portions "A" keep a distance of about 1 cm from each other. The waterproof sheets 20 are laid on the upper surface of a slab layer 10, in a state where hair roots 23 produced on the bottom of a nonwoven fabric 22 are implanted into the upper surface of an asphalt sheet 21, and hair trunks 24 produced on the top of the nonwoven fabric 22 are protruded externally.

In the coating waterproofing layer forming step, the coating waterproofing layer 30 is formed by coating liquid-phase polyurethane on the upper surface of the waterproof sheet 20. In the finish layer formation step, the finish layer is formed on the upper surface of the coating waterproofing layer 30, to protect the coating waterproofing layer 30.

In the present invention as described above, the waterproof sheet comprised of the asphalt sheet 21 and the nonwoven fabric 22 is preferably fabricated in factories and laid in working sites, and then the coating waterproofing layer 30 is coated on the upper surface of the grounding waterproof sheet, to thereby accomplish a very convenient waterproof construction work, differently from the conventional art using a thermal source to fuse.

Figure 8A:
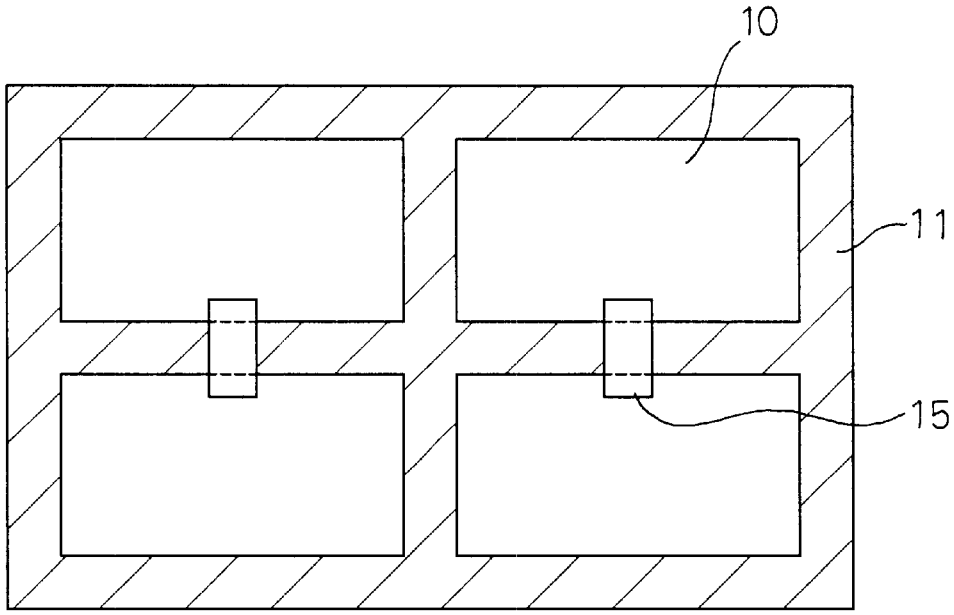
FIGS. 8A to 8E are plan views showing construction steps of the hybrid waterproofing structure in accordance with another waterproofing construction method of the present invention.

FIGS. 8A to 8E illustrate construction steps of the hybrid waterproofing structure in accordance with another waterproofing construction method of the present invention. In the adhesive material layer forming step, an adhesive material layer 11 is formed by applying an adhesive material to the upper surface of a slab layer 10 as shown in FIG. 8A. In this case, the adhesive layer 11 is partially formed by coating subsequently primer and liquid-phase polyurethane, in a rectangular band pattern having a width of 10 cm, on the surface of the slab layer 10. Next, a plurality of polyurethane film patch 15 are laid on the adhesive layer 11 in a predetermined space to form air vent between adhesive patterns. Each film patch 15 is preferably of about 15 cm×30 cm, but other dimensions may also be used.

Figure 8B:
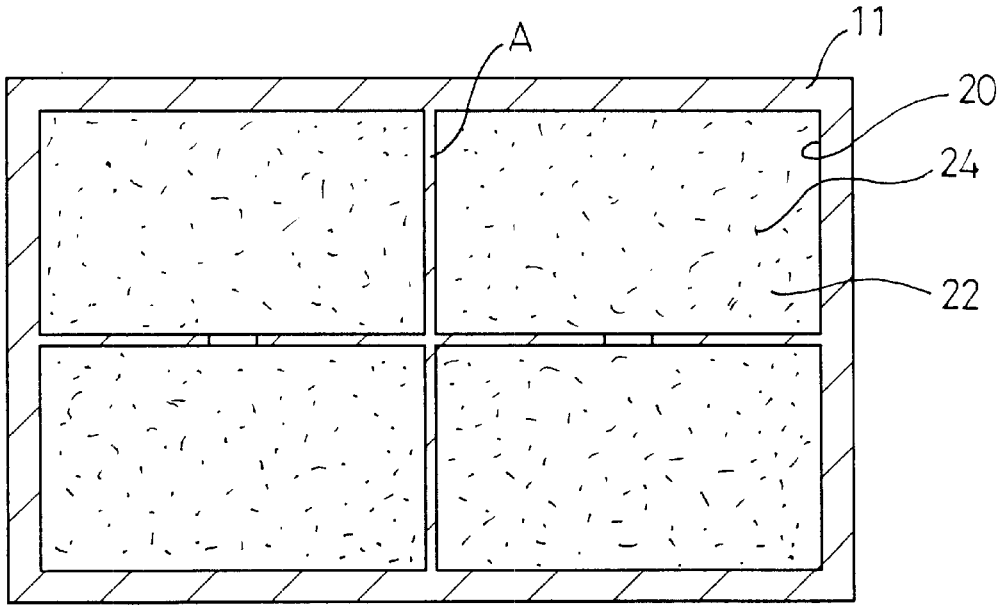

Then, in the waterproof sheet laying step as shown in FIG. 8B, the waterproof sheet 20 having a thickness of about 2.5 mm, length of about 15 m and width of about 10 m and fabricated in the form of rolls is laid on the upper surface of the adhesive material layer 11, in which the edges of connection portions "A" keep a distance of 1 cm between the waterproof sheets 20 and 20. The waterproof sheets 20 are laid in a state where hair roots produced on the bottom of a nonwoven fabric 22 are implanted into the upper surface of an asphalt sheet 21, and hair trunks 24 produced on the top of the nonwoven fabric 22 are protruded externally.

Figure 8C:
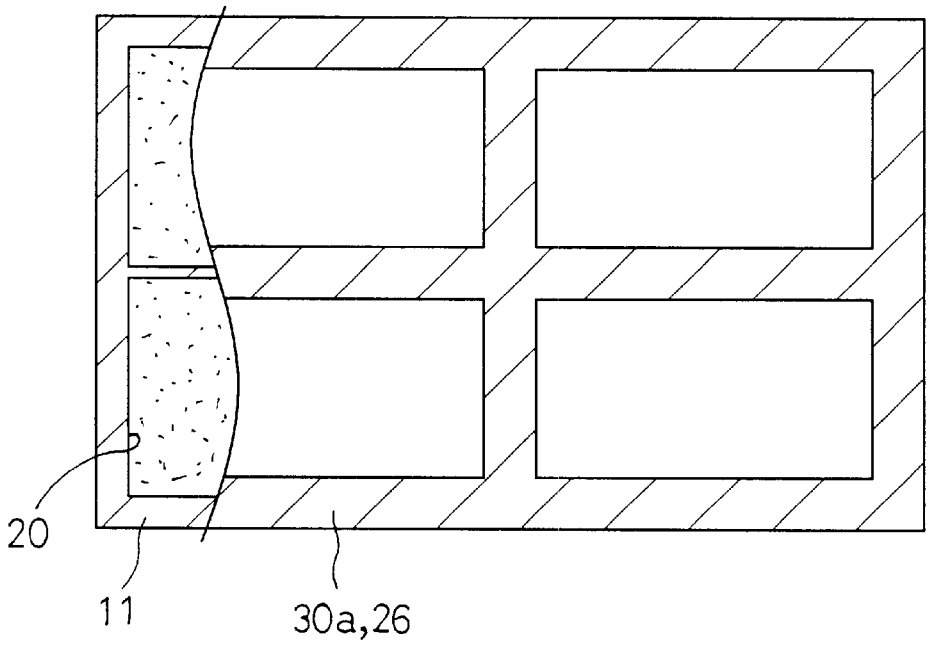
Figure 8D:
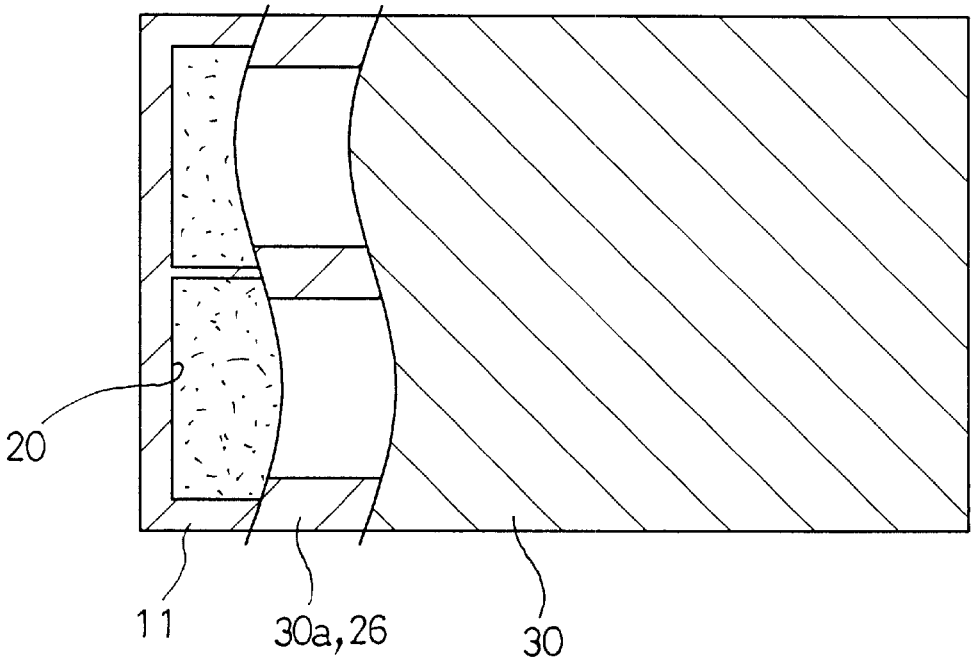
Figure 8E:
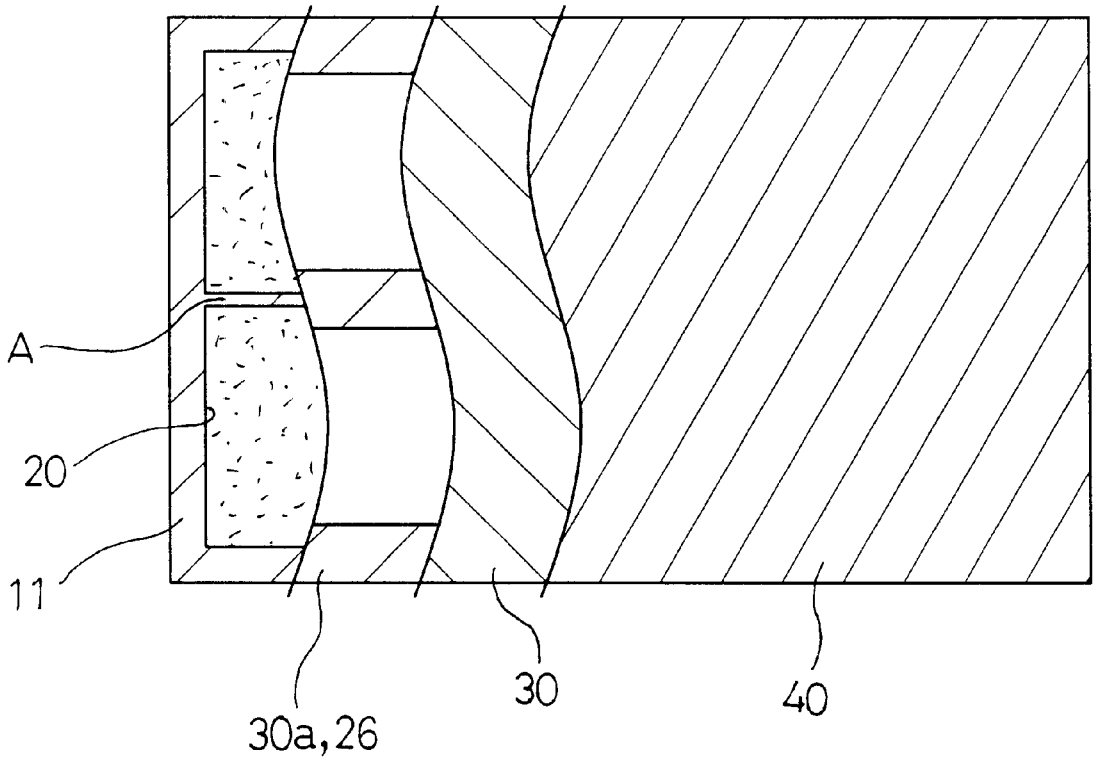

Next, in the coating waterproofing layer forming step as shown in FIG. 8C, the coating waterproofing layer 30*a* is formed in a rectangular-band pattern by coating, for example, liquid-phase polyurethane in the same pattern as that of the adhesive layer 11 including the edges of connection portions "A", covering a glass fiber fabric 26 on the coating waterproofing layer 30*a* of rectangular band pattern, and then, coating liquid-phase polyurethane on the whole surface of the waterproof sheet 20 in a predetermined thickness to form the coating waterproofing layer 30.

In this case, the glass fiber fabric 26 may be used for reinforcing the coating waterproofing layer 30.

In the finish layer formation step, the finish layer 40*a* is formed on the upper surface of the coating waterproofing layer 30, to protect the coating waterproofing layer 30. The finish layer 40*a* is formed of a sand layer 41 for non-slip, anti-shock, anti-fire, and light blocking, and color top coating 42 for giving color to the top surface. Further, rubber may be used instead of the sand layer 41 as needed.

The finish layer 40*a* is constructed in case that the top surface is exposed to the light, but it is not used unless the top surface is exposed to the light.

Figure 9:
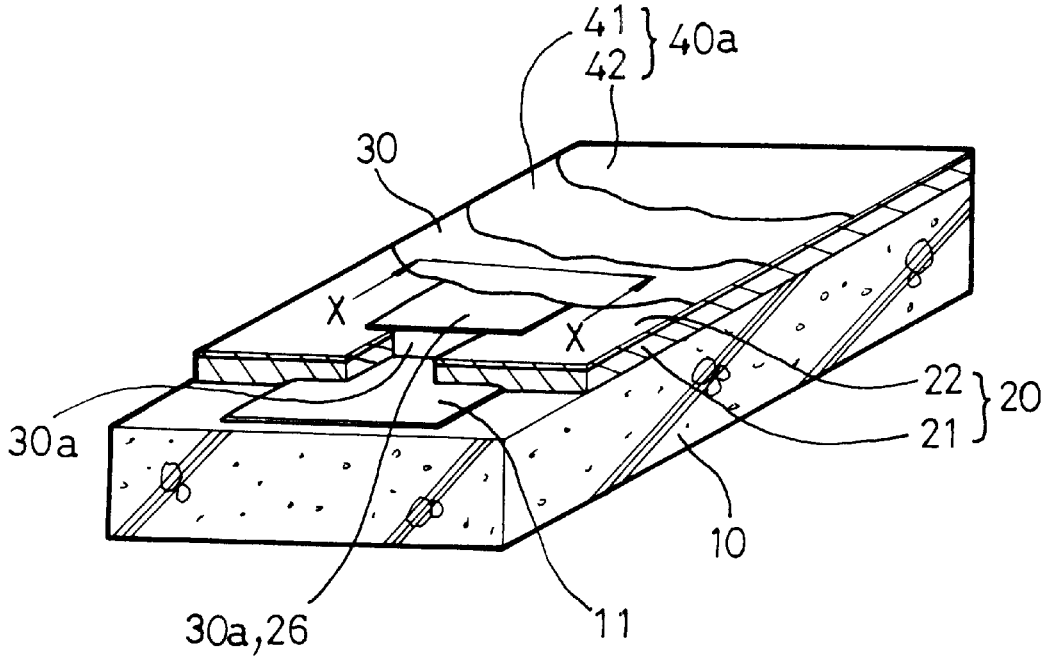
FIG. 9 is a partially removed perspective view of FIG. 8E.

The hybrid waterproofing structure constructed according to the waterproofing construction method is shown in FIG. 9. As described above, the waterproof sheets 20 are partially adhered to the slab layer 10, and air vents are formed through the film patches 15 and between bottom spaces formed in non-contacting portions below the waterproof sheets 20. Thus, though cracks occurs in the slab layer 10, the coating waterproofing layer 30 and the waterproof sheets 20 can endure such cracks. The remaining water and air in the concrete slab layer 10 can also exit through the air vents from inside to outside, bubbling and swelling are prevented.

Figure 10:
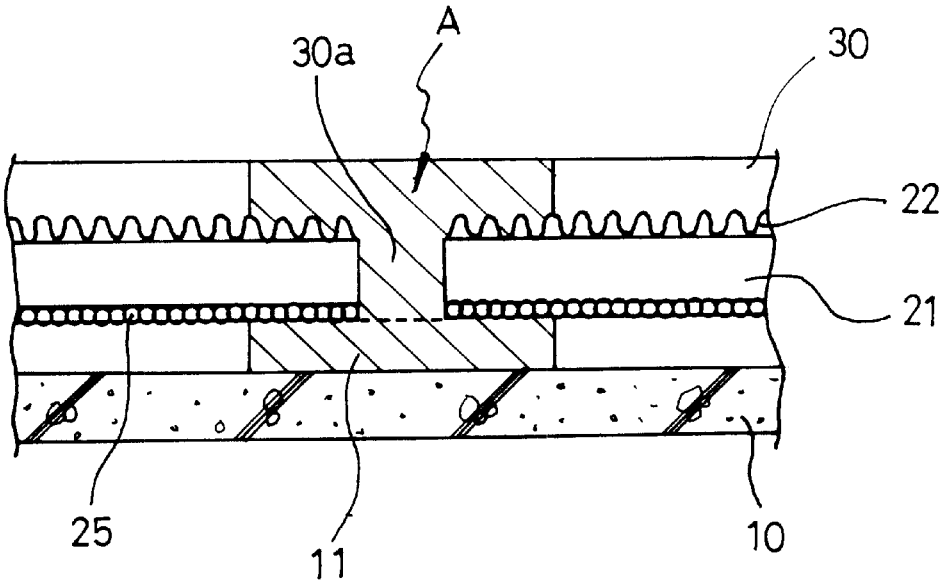
FIG. 10 is a cross-sectional view taken along line X—X in FIG. 9.

Further, as shown in FIG. 10, each of connection portions "A" has a structure in which a cross-section of the adhesive layer 11 and the coating waterproofing layer 30*a* forms "I" shape to thereby fix the coating waterproofing layer 30 to the waterproof sheets 20.

Other features are the same as that of the first and second embodiments and will not be repeated.

As described above, the hybrid waterproofing structure according to the present invention hybridizes the asphalt sheet on the upper surface which the nonwoven fabric is attached with the coating waterproofing layer, to take the merits of the two materials and supplement the demerits thereof.

In other words, the present invention is characterized in that the liquid-phase coating waterproofing layer is coated on the upper surface of the waterproof sheet where the hair roots produced on the bottom of the nonwoven fabric are implanted into the upper surface of the asphalt sheet and the hair trunks produced on the top of the nonwoven fabric are protruded externally. Thus, the present invention has the following effects.

(1) An adhesive force between the waterproof sheets and the coating waterproofing layer is increased.

(2) A thermal source is not used but a complete cool hardening method is used.

(3) An integrity of a connection portion is insured to thereby eradicate occurrence of defects.

(4) A waterproof sheet is previously fabricated in factories and laid on working sites, to thereby make the whole construction work quick, convenient and simple.

(5) the coating waterproofing layer can be formed as a waterproof layer having a uniform thickness and no joint portion and the nonwoven fabric reinforces the coating waterproofing layer as a reinforcing material, since a predetermined amount of the liquid-phase coating waterproofing material is coated on the nonwoven fabric.

(6) Bubbling and swelling problems can be reduced or prevented and the coating waterproofing layer is not affected by a water containing condition of the concrete, since the coating waterproofing layer is formed on the nonwoven fabric.

As described above, the present invention has been described as particularly preferred embodiments. However, the present invention is not limited in the above embodiments and various modifications and changes are possible by one skilled in the art within the scope without departing from the spirit of the present invention.

What is claimed is:

1. A waterproofing structure formed above a slab layer, comprising:

a plurality of waterproof sheets arranged adjacent to each other with adjacent end edges of the adjacent sheets being spaced apart and defining a joint region representing an area between the adjacent waterproof sheets which are separated by a predetermined distance, the plurality of grounding waterproof sheets being disposed above the slab layer, wherein each one of the waterproof sheets has:

a water-proof first layer arranged above the slab layer, the first layer having first and second surfaces; and a second layer affixed to the first surface of the first layer, the second layer having fibers extending from at least one surface of the second layer into and adhering to the first layer; and a hardenable polymer layer formed by coating polymer on the upper surface of the plurality of grounding waterproof sheet.

2. The waterproof structure of claim 1, wherein the polymer layer is formed above the joint region.

3. The waterproofing structure of claim 1, wherein the polymer layer is formed substantially on an entire upper surface of the plurality of grounding waterproof sheets.

4. The waterproof structure of claim 1, wherein the polymer layer is made from one of polyurethane, epoxy, poly-urea, EVA emulsion, asphalt emulsion and acryl emulsion.

5. The waterproof structure of claim 1, wherein edges of the waterproof sheets have an adhesive layer adhered on an upper surface of the slab layer, and wherein said patches are laid on the adhesive layer for forming passages between adjacent waterproof sheets.

6. The waterproofing structure of claim 1, further comprising glass fiber fabric inserted between connection points of the waterproof sheets and the hardenable polymer layer for reinforcing the connection portions and the hardenable polymer layer.

7. The waterproof structure of claim 1, wherein the first layer is an asphalt sheet.

8. The waterproofing structure of claim 1, wherein the second layer is a nonwoven material.

9. The waterproofing structure of claim 7, wherein the second layer is a nonwoven material.

10. The waterproof structure of claim 1, wherein said second layer includes second fibers which extend from a second surface of the second layer opposite said one surface and into and adhering to the polymer layer.

11. The waterproof structure of claim 1, further comprising a third layer affixed to the second surface of the first layer, the third layer having fibers extending from at least one surface and adhering to the first layer.

12. The waterproof structure of claim 11, wherein the third layer is a nonwoven material.

13. The waterproof structure of claim 9, wherein second fibers extending from a top surface of the nonwoven material are implanted and fused into the asphalt sheet, and said fibers extending from said one surface of the nonwoven material protrude externally.

14. The waterproofing structure of claim 1, further comprising an adhesive layer disposed between the plurality of waterproof sheets and the slab layer.

15. A method of preparing a waterproofing structure on a slab layer, comprising the steps of:

arranging a plurality of grounding waterproof sheets on the slab layer, wherein the grounding waterproof sheets are arranged adjacent to each other with adjacent end edges of the adjacent sheets being spaced apart and defining a joint region representing an area between the adjacent waterproof sheets which are separated by a predetermined distance, each one of grounding waterproof sheet having:

a water-proof first layer arranged above the slab layer, the first layer having first and second surfaces; and a second layer affixed to the first surface of the first layer, the second layer having fibers extending from at least one surface of the second layer into and adhering to the first layer; and coating at least the joint region of the grounding waterproof sheets with hardenable polymer to form a polymer layer.

16. The method of claim 15, wherein the polymer is coated substantially on an entire upper surface of the plurality of grounding waterproof sheets.

17. The method of claim 15, wherein the first layer is an asphalt sheet.

18. The method of claim 15, wherein the second layer is a nonwoven fabric.

19. The method of claim 15, wherein said second layer includes second fibers which extend from a second surface of the second layer opposite said one surface and into and adhering to the polymer layer.

20. The method of claim 15, further comprising a third layer affixed to the second surface of the first layer, the third layer having fibers extending from at least one surface and adhering to the first layer, wherein the third layer is a nonwoven fabric.

21. The method of claim 15, wherein the polymer is polyurethane.

22. A waterproofing structure construction method comprising the steps of:

forming an adhesive material layer by applying an adhesive material to an upper surface of a slab layer in order to enhance an adhesive force;

laying a plurality of waterproof sheets, each having a predetermined thickness and width, and said upper surface, adjacent edges of said waterproof sheets being spaced a predetermined distance from each other, when the waterproof sheets are laid on the upper surface of the adhesive layer, hair roots of a nonwoven fabric being implanted and fused into an upper surface of an asphalt sheet, and hair trunks of the nonwoven fabric protrude externally;

forming a coating waterproofing layer by coating liquid-phase coating waterproofing material on the upper surface of the waterproof sheet; and forming a finish layer on the upper surface of the coating waterproofing layer, to protect the coating waterproofing layer.

23. The waterproofing structure construction method of claim 22, wherein the adhesive layer is formed in a rectangular-band pattern.

24. The waterproof structure construction method of claim 22, wherein the coating waterproofing layer is made from one of polyurethane, epoxy, poly-urea, EVA emulsion, asphalt emulsion and acryl emulsion.

25. The waterproofing structure construction method of claim 22 further comprising the step of forming glass fiber fabric between connection portions of the waterproof sheets and the coating waterproofing layer to reinforce the connection portions and the coating waterproofing layer.

26. The waterproofing structure construction method of claim 22, wherein the adhesive layer and the coating waterproofing layer above, below and in a space between adjacent edges of said waterproof sheets have a cross-section with a generally "I" shape to thereby fix the coating waterproofing layer to the waterproof sheets.

* * * * *